US006666221B1

(12) United States Patent
Booth

(10) Patent No.: US 6,666,221 B1
(45) Date of Patent: Dec. 23, 2003

(54) COMBINATION CHAIR AND UMBRELLA

(76) Inventor: Tamme Glanise Booth, 6 Gesner Dr., Spring Valley, NY (US) 10977

( * ) Notice: Subject to any disclaimer, the term of this patent is extended or adjusted under 35 U.S.C. 154(b) by 29 days.

(21) Appl. No.: 10/177,370

(22) Filed: Jun. 19, 2002

(51) Int. Cl.[7] ..... A45B 3/00; A45B 11/00; A47C 7/66

(52) U.S. Cl. ..... 135/16; 297/184.11; 297/184.16; 297/188.2; D6/416; 248/511; 248/225.21

(58) Field of Search ..... 135/16; 297/184.16, 297/184.11, 188.2; 248/225.21, 224.8, 220.31, 511, 682, 539; D6/416

(56) References Cited

U.S. PATENT DOCUMENTS 309,451 A * 12/1884 Ford
549,049 A * 10/1895 Batty
595,218 A * 12/1897 Stauffer
D250,300 S 11/1978 Rohr
4,789,200 A * 12/1988 Munguia
4,823,821 A 4/1989 Day
5,110,184 A 5/1992 Stein et al.
5,255,954 A * 10/1993 Rogers
5,350,215 A 9/1994 DeMars
5,641,197 A 6/1997 Springmann

* cited by examiner

*Primary Examiner*—Robert Canfield
(74) *Attorney, Agent, or Firm*—Gene Scott-Patent Law & Venture Group

(57) ABSTRACT

A chair provides a chair seat portion and a chair back portion and an umbrella assembly adapted for mounting on the chair back portion. The umbrella assembly includes a receiver tube adapted for receiving an umbrella post to support the umbrella in an upright attitude. The receiver tube provides a pair of L-shaped ears extending from an exterior surface, and the chair back portion provides a mounting block engaged on a rear surface of the chair back portion. The mounting block is adapted for receiving the pair of L-shaped ears within a corresponding pair of L-shaped holes within the mounting block so as to stabilize the umbrella assembly on the chair.

4 Claims, 5 Drawing Sheets

Prior Art

COMBINATION CHAIR AND UMBRELLA

BACKGROUND OF THE INVENTION

1. Field of the Invention

This invention relates generally to equipment used for sun shading and more particularly to a combination chair and umbrella assembly adapted for convenient use and easy of breakdown for storage or portability.

2. Description of Related Art

The following art defines the present state of this field:

Rohr, U.S. Des. Pat. No. 250,300 describes a combined chair and parasol design.

Day, U.S. Pat. No. 4,823,821 describes an umbrella expanded by spring action and collapsed by spring action. Both spring actions are initiated by a single push button which is manually manipulated in the same manner for initiating both spring actions.

Stein et al., U.S. Pat. No. 5,110,184 describes a novel beach chair which is supported on a spike that is connected to the lower portion of the chair by a bearing arrangement such that when the spike is inserted into the ground the upper portion upon which a person is seated can be rotated relative to the lower portion of the spike to allow the seat to be rotated so as to follow the sun or for other purposes. Umbrella and pockets are also provided on the chair as well as a handle and ground wheels for moving the chair to and from the beach.

DeMars, U.S. Pat. No. 5,350,215 describes a chair that is constructed of a plurality of interconnected tubular frame members with a flexible fabric-like cover covering sections of the tubular frame members forming a back section and a seat section. The chair is foldable from an extended/usable position to a retracted/stowage position. The chair includes armrests and attached to each armrest is a flexible walled container which is insulated to be usable to store beverage containers in a refrigerated condition. These flexible walled containers are joinable together when the chair is in the retracted/stowage position with the joining of these containers facilitating retaining of the chair in this retracted/stowage position. Back pack straps are attached to the back section which permits the chair to be carried on the back of a human being when the chair is in the retracted/stowage position.

Springmann, U.S. Pat. No. 5,641,197 describes an improved collapsible sports chair of the type having a collapsible chair assembly including a collapsing frame having four leg members, a seat support member supported by the four leg members, and a back support member hingedly connected to the seat support member wherein the improvement comprises the addition of a cooler assembly, including a rail mechanism and a cooler member slidably connected with the rail mechanism, secured beneath the seat support member; a multi-position umbrella support mechanism, secured to the back surface of the back support member; and a flexible storage bag member having four flexible tether members each including a securing clip attached to the distal end thereof, each securing clip being insertable within one of four securing clip receiving members provided on the back surface of the back support member.

The prior art teaches the user of umbrellas with beach chairs and the like, but does not teach a simple locking-ear method of attachment of an umbrella to a chair. The present invention fulfills these needs and provides further related advantages as described in the following summary.

SUMMARY OF THE INVENTION

The present invention teaches certain benefits in construction and use which give rise to the objectives described below.

A chair provides a chair seat portion and a chair back portion and an umbrella assembly adapted for mounting on the chair back portion. The umbrella assembly includes a receiver tube adapted for receiving an umbrella post to support the umbrella in an upright attitude. The receiver tube provides a pair of L-shaped ears extending from an exterior surface, and the chair back portion provides a mounting block engaged on a rear surface of the chair back portion. The mounting block is adapted for receiving the pair of L-shaped ears within a corresponding pair of L-shaped holes in the mounting block so as to stabilize the umbrella assembly on the chair and yet allow it to be easy removed as desired.

A primary objective of the present invention is to provide an apparatus and method of use of such apparatus that provides advantages not taught by the prior art.

Another objective is to provide such an invention capable of mounting an umbrella on a chair back.

A further objective is to provide such an invention capable of enabling simple removal of the umbrella as desired.

A still further objective is to provide such an invention capable of simple and secure mounting to a chair back.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
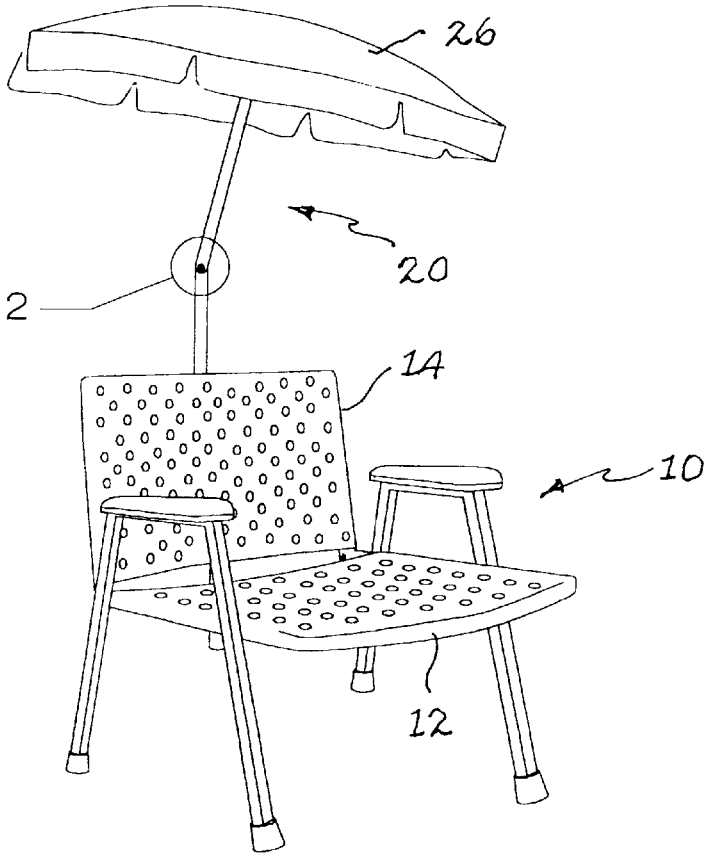
FIG. 1 is a perspective view of the preferred embodiment of the invention.
Figure 5:
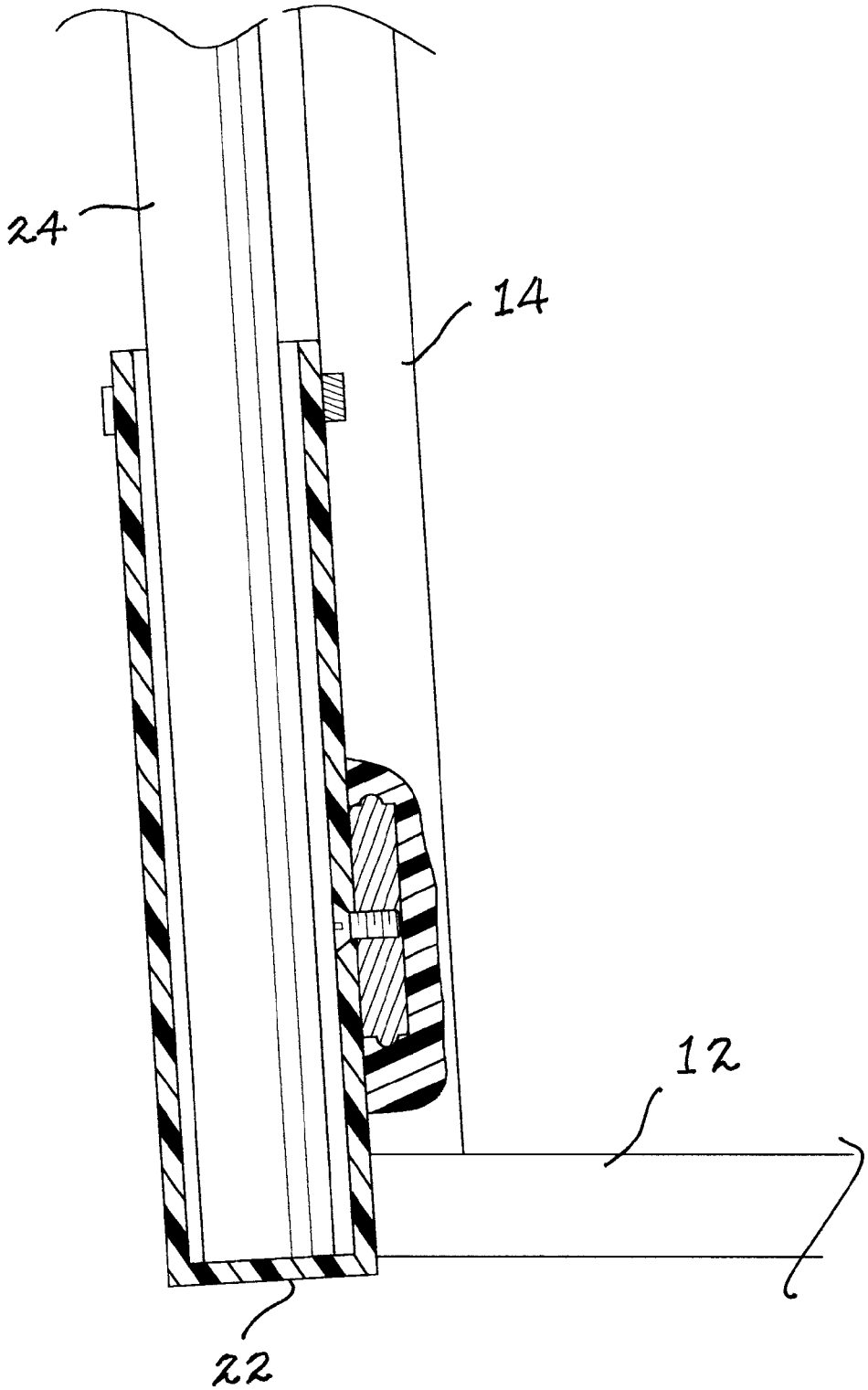
FIG. 5 is a sectional view taken along line 5—5 in FIG. 3.
Figure 7:
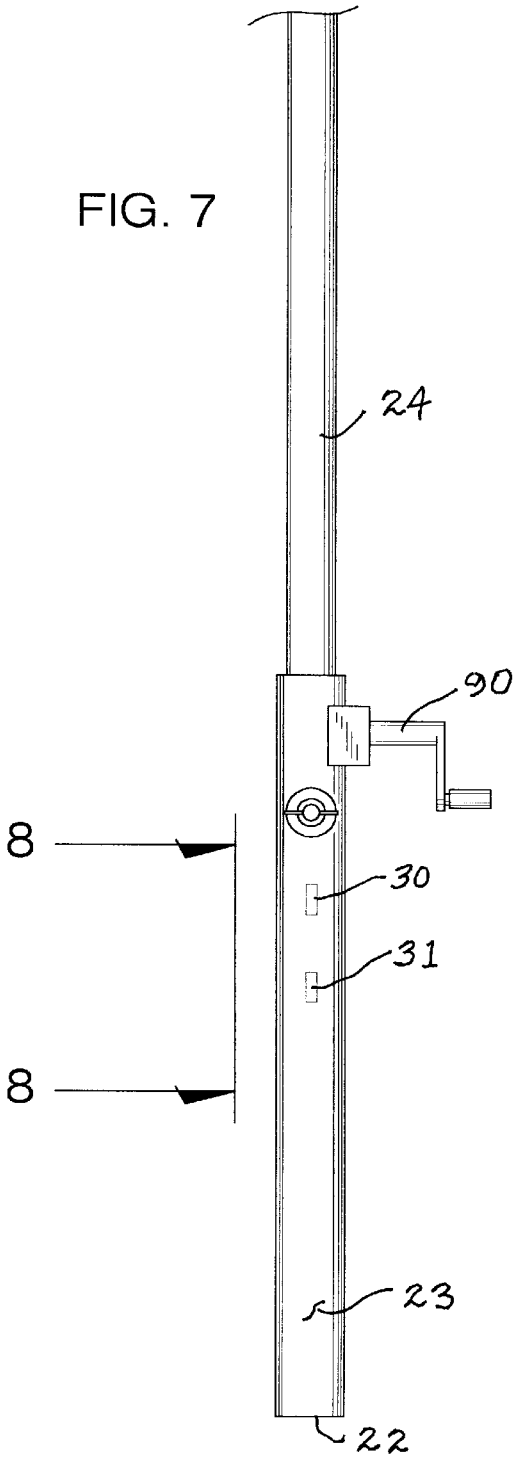
FIG. 7 is a front elevational view of an umbrella receiver of the invention.
Figure 8:
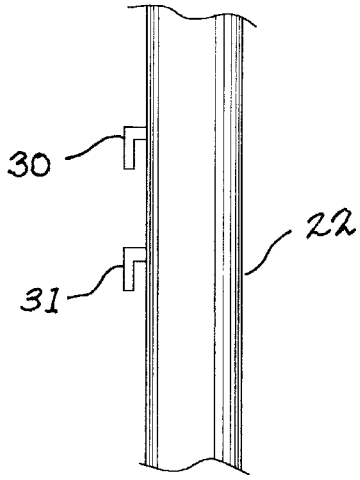
FIG. 8 is a partial side elevational view taken from FIG. 7.

The present invention is an apparatus comprising in combination: a chair 10 having a chair seat portion 12 and a chair back portion 14, and an umbrella assembly 20 adapted for being mounted on the chair back portion 14 of the chair 10, as shown in FIG. 1. The umbrella assembly 20 includes a receiver tube 22 adapted for receiving an umbrella post 24 of an umbrella 26. The receiver tube 22 provides a pair of L-shaped ears 30, 31 extending from an exterior surface 23 of the receiver tube 22 and this is shown in FIGS. 7 and 8. The chair back portion 14 provides a mounting block 40 engaged on a rear surface 15 of the chair back portion 14. The mounting block 40 is adapted for receiving the pair of L-shaped ears 30, 31 within a corresponding pair of L-shaped holes 30', 31' within the mounting block 40. A simpler manner for mounting the receiver is shown in FIG. 5 wherein the receiver tube 22 is screwed directly to the structural members of the chair 10.

Figure 2:
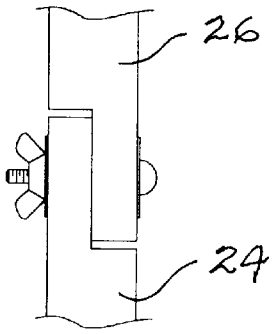
FIG. 2 is a partial view thereof as taken from FIG. 1.
Figure 3:
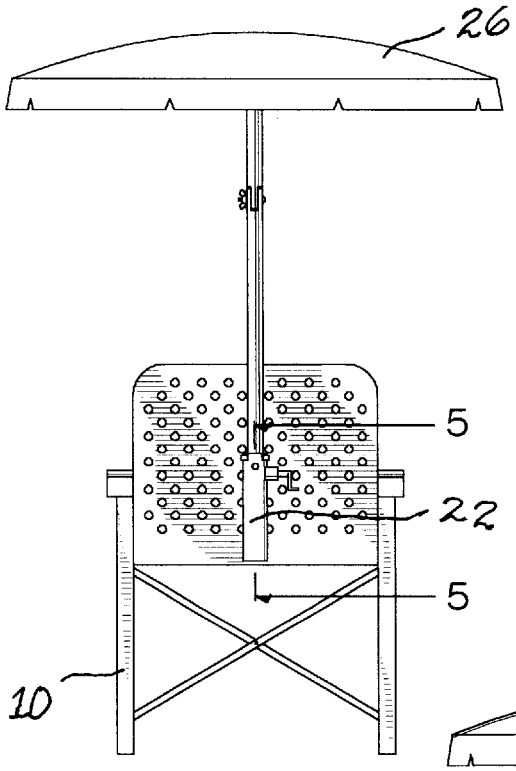
FIG. 3 is a front elevational view thereof.
Figure 4:
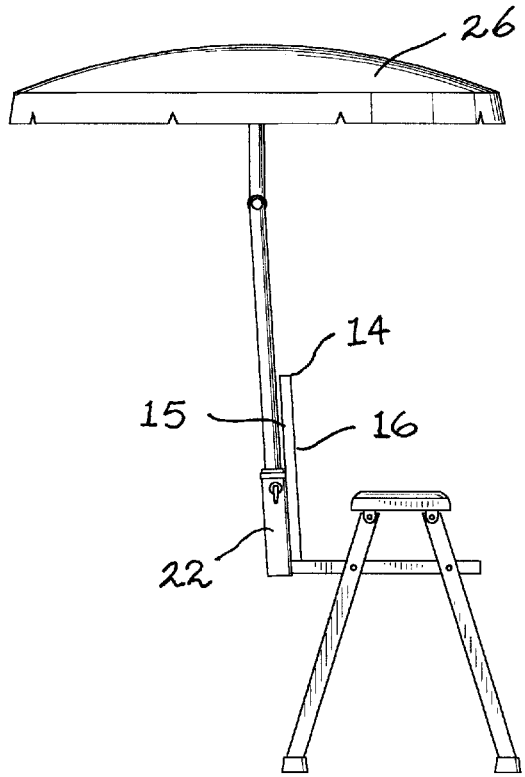
FIG. 4 is a side elevational view thereof.
Figure 6:
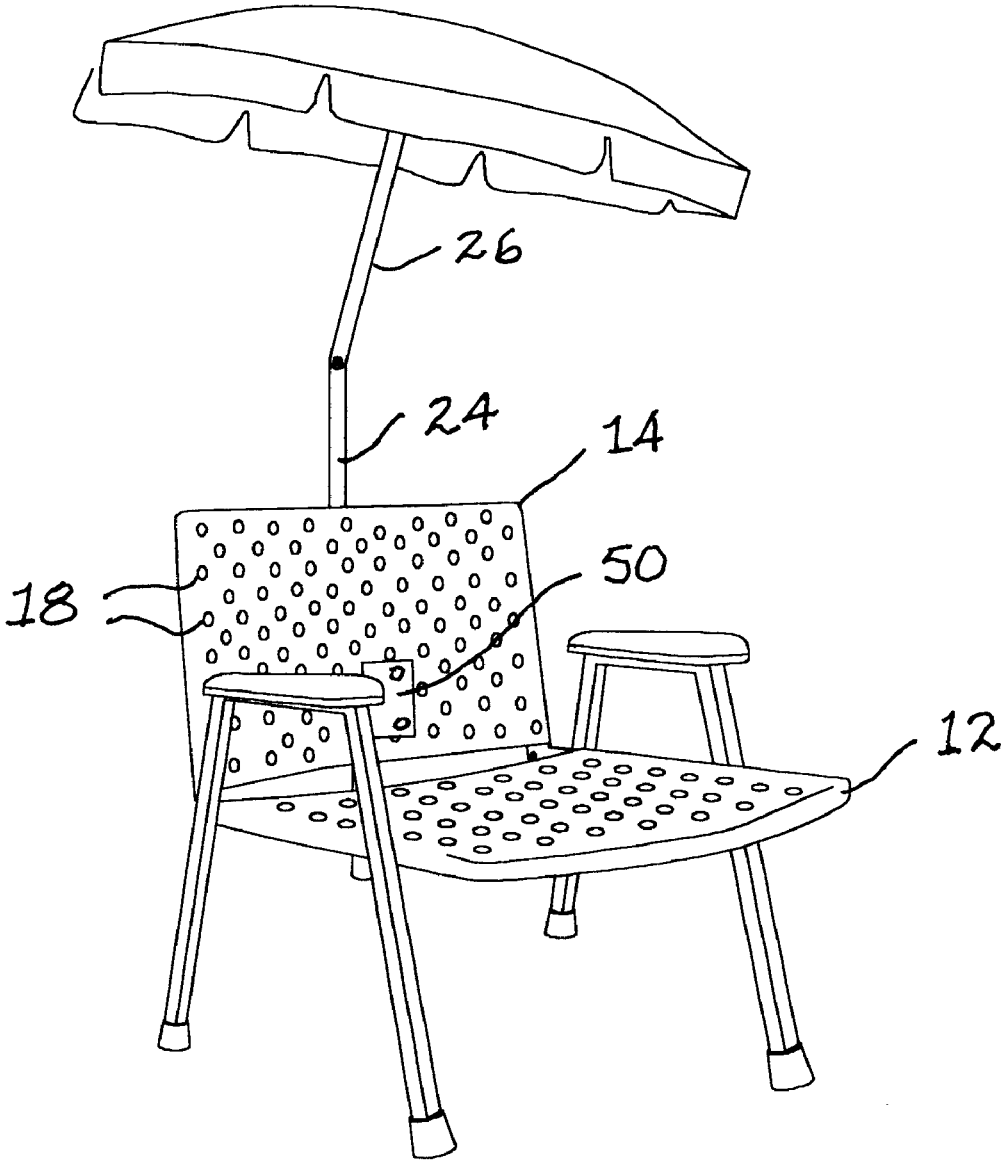
FIG. 6 is similar to FIG. 1 but showing the position of a screw plate of the invention.

FIG. 2 shows a typical knuckle joint as is well known in the art of umbrellas and is used to position the umbrella top portion as shown in FIG. 6.

Figure 9:
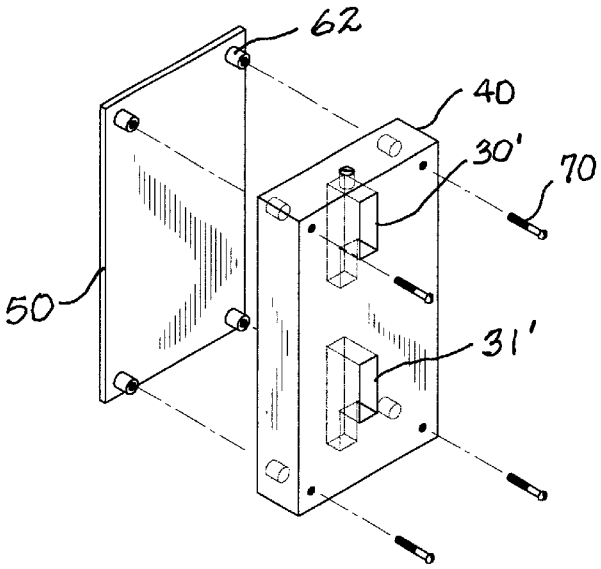
FIG. 9 is an exploded view of mounting hardware of the invention.

Preferably, the L-shaped ears 30, 31, shown in FIG. 7, and the L-shaped holes 30', 31' shown in FIG. 9, are each positioned along a vertical line with one of the L-shaped ears 30 positioned above the other 31, and one of the L-shaped holes 30' above the other 31' respectively. When the ears are inserted into the holes the ears are locked into the holes by virtue of the shape of ears and holes and the fact that the weight of the umbrella 20 causes the ears to be fixed into the holes.

Preferably, the mounting block 40 forms a butting relationship with a back surface 15 of the chair back portion 14 and a screw plate 50 forms a corresponding butting relationship with a front surface 16 of the chair back portion 14, the mounting block 40 and the screw plate 50 are joined by fasteners 70 engaged through the chair back portion 14 such that the chair back portion 14 is sandwiched between them.

Preferably, the chair back portion 14 provides plural holes 18 for accepting threaded standoffs 62 fixed to the screw plate 50. In FIG. 6 the screw plate 50 is shown in its mounted position on the front surface of the chair back portion 14.

In use the umbrella 20 may be mounted onto the chair 10 or removed readily. A crank mechanism 90 may be used to raise and lower the umbrella 20 within the receiver 22 in a manner that is well known in the art, and as mentioned above the umbrella may be angularly positioned to provide shade from the sun's rays as desired. When ready to fold the chair and depart, the umbrella assembly is able to be quickly removed from the chair 10, folded and stored.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus comprising in combination: a chair having a chair seat portion and a chair back portion; and an umbrella assembly adapted for mounting on the chair back portion of the chair; the umbrella assembly including a receiver tube adapted for receiving an umbrella post, the receiver tube providing a pair of L-shaped ears extending from an exterior surface of the receiver tube; the chair back portion providing a mounting block engaged therewith on a rear surface of the chair back portion, the mounting block adapted for receiving the pair of L-shaped ears within a corresponding pair of L-shaped holes within the mounting block.

2. The apparatus of claim 1 wherein the L-shaped ears and the L-shaped holes are each positioned along a vertical line with one of the L-shaped ears above the other thereof, and one of the L-shaped holes above the other thereof.

3. The apparatus of claim 1 wherein the mounting block forms a butting relationship with a back surface of the chair back portion and a screw plate forms a corresponding butting relationship with a front surface of the chair back portion, the mounting block and the screw plate joined by fasteners engaged through the chair back portion such that the chair back portion is sandwiched therebetween.

4. The apparatus of claim 3 wherein the chair back portion provides plural holes for accepting threaded standoffs fixed to the screw plate.

* * * * *